US008701899B2

(12) United States Patent
Paga et al.

(10) Patent No.: US 8,701,899 B2
(45) Date of Patent: Apr. 22, 2014

(54) ONE-PIECE PAINT BRUSH HOLDER AND PAINT BRUSH HOLDER ASSEMBLY

(76) Inventors: Henry F. Paga, Royal Oak, MI (US); Guy D. Vaiasicca, Royal Oak, MI (US)

( * ) Notice: Subject to any disclaimer, the term of this patent is extended or adjusted under 35 U.S.C. 154(b) by 65 days.

(21) Appl. No.: 13/293,661

(22) Filed: Nov. 10, 2011

(65) Prior Publication Data

US 2013/0119003 A1 May 16, 2013

(51) Int. Cl.

| | |
|---|---|
| ***A47B 81/02*** | (2006.01) |
| ***A46B 17/02*** | (2006.01) |
| ***B44D 3/12*** | (2006.01) |
| ***A47K 1/09*** | (2006.01) |
| ***A47L 13/512*** | (2006.01) |
| ***A47B 55/02*** | (2006.01) |

(52) U.S. Cl.

CPC . *B44D 3/123* (2013.01); *A47K 1/09* (2013.01); *A47L 13/512* (2013.01); *A47B 55/02* (2013.01)

USPC ..... 211/65; 211/70.6; 211/181.1; 248/112; 248/302

(58) Field of Classification Search

CPC ..... A46B 17/02; A47K 1/09; B44D 3/006; B44D 3/12; B44D 3/121; B44D 3/123; B44D 3/125; A47L 13/512; A47L 13/51; A47L 13/50; A47F 5/01; A47F 5/13; A47F 5/14; A47F 7/148; A47F 5/0031; A47B 73/002; A47B 55/02; A47J 47/16; A47G 7/045

USPC ..... 211/65, 66, 181.1, 113, 119, 85.31, 211/85.26, 13.1, 59.1, 70.6, 133.1, 133.2; 248/110, 112, 113, 211, 302, 303; 206/209, 361, 362, 362.3, 15.2, 15.3; 220/736, 743; 15/157.01, 246

See application file for complete search history.

(56) References Cited

U.S. PATENT DOCUMENTS

| | | | | | |
|---|---|---|---|---|---|
| 1,048,192 | A | * | 12/1912 | McMillan | 248/311.2 |
| 1,551,242 | A | * | 8/1925 | Dick | 248/146 |
| 2,315,269 | A | * | 3/1943 | Morgillo | 248/110 |
| 2,466,850 | A | * | 4/1949 | Hoffman et al. | 220/697 |
| 2,472,001 | A | * | 5/1949 | Buhoveckey | 206/209 |
| 2,521,049 | A | * | 9/1950 | Divis | 248/110 |
| 2,566,650 | A | * | 9/1951 | Anderson | 211/65 |
| RE23,911 | E | * | 12/1954 | Tatter | 220/701 |
| 2,742,180 | A | * | 4/1956 | Miljevich | 220/702 |
| 2,744,635 | A | * | 5/1956 | Hiss | 211/65 |
| 2,791,350 | A | * | 5/1957 | Mennen | 220/620 |
| 2,815,146 | A | * | 12/1957 | Silver | 220/698 |

(Continued)

*Primary Examiner* — Jennifer E Novosad

(74) *Attorney, Agent, or Firm* — Brooks Kushman P.C.

(57) ABSTRACT

A one-piece paint brush holder for removable-insertion use with a container having a bottom surface, an inner side wall and an upper edge is provided in one embodiment. The holder includes a base portion. The holder further includes a post portion having a lower end extending from the base portion, an intermediate portion extending upwardly from the lower end, and an upper end supported above and extending from the intermediate portion. The holder still further includes a generally horizontal support portion extending from the upper end of the post portion and having a distal end. The intermediate portion of the post portion has a hook portion vertically between the base portion and the support portion. The hook portion has a downwardly opening shape to permit the holder to be supported on the upper edge of the container at a position above an inserted position in the container. The base, post, hook and support portions are formed by bending a single rod. In another embodiment, a paint brush holder assembly having various attachment portions is provided.

7 Claims, 3 Drawing Sheets

(56) References Cited

U.S. PATENT DOCUMENTS

| | | | | | |
|---|---|---|---|---|---|
| 2,823,399 | A | * | 2/1958 | Stewart | 401/121 |
| 2,868,385 | A | * | 1/1959 | Dreyfus, Jr. | 211/85.31 |
| 2,952,364 | A | * | 9/1960 | Jacobson | 211/65 |
| 3,819,140 | A | * | 6/1974 | Stewart | 248/110 |
| 3,905,476 | A | * | 9/1975 | Foreman | 206/361 |
| 4,025,206 | A | * | 5/1977 | Rubin | 401/123 |
| 4,721,225 | A | * | 1/1988 | Sobel | 220/736 |
| 4,852,833 | A | * | 8/1989 | Lockwood | 248/110 |
| 4,944,415 | A | * | 7/1990 | Orbach | 211/75 |
| 5,016,773 | A | * | 5/1991 | Lockwood | 220/697 |
| 5,035,386 | A | * | 7/1991 | Tucker | 248/110 |
| 5,046,623 | A | * | 9/1991 | Takacs | 211/65 |
| D324,541 | S | * | 3/1992 | Dudley | D19/35 |
| 5,107,877 | A | * | 4/1992 | Chipman | 134/140 |
| 5,645,091 | A | * | 7/1997 | Hoeft | 134/84 |
| 5,740,928 | A | * | 4/1998 | Dale et al. | 211/71.01 |
| 5,806,818 | A | * | 9/1998 | Heywood | 248/213.2 |
| 5,829,603 | A | * | 11/1998 | Martineau | 211/66 |
| 5,833,080 | A | * | 11/1998 | Donne | 211/85.31 |
| 6,193,080 | B1 | * | 2/2001 | Castillo | 211/66 |
| D486,320 | S | | 2/2004 | Grimberg | |
| 6,820,848 | B1 | * | 11/2004 | Adam | 248/213.2 |
| 7,118,078 | B2 | | 10/2006 | Vukas | |
| 7,281,469 | B1 | * | 10/2007 | Barbour et al. | 99/426 |
| 7,819,366 | B2 | * | 10/2010 | Paga et al. | 248/110 |
| 8,100,272 | B1 | * | 1/2012 | Schaefer | 211/65 |
| 2005/0194275 | A1 | | 9/2005 | Balogh | |
| 2005/0269469 | A1 | * | 12/2005 | Cummins | 248/303 |
| 2006/0289367 | A1 | * | 12/2006 | Cossey | 211/13.1 |
| 2007/0045132 | A1 | | 3/2007 | Anderson | |

* cited by examiner

ONE-PIECE PAINT BRUSH HOLDER AND PAINT BRUSH HOLDER ASSEMBLY

TECHNICAL FIELD

The invention relates to paint brush holders and assemblies of such holders.

OVERVIEW

Prior art references include U.S. Patent Application Publication Nos. 2007/0045132 A1 and 2005/0194275 A1 and U.S. Pat. Nos. 1,551,242; 2,315,269; 2,952,364; 3,905,476; 4,025,206; 4,721,225; 4,852,833; 5,016,773; 5,035,386; 5,046,623; 5,645,091; 5,806,818; 5,829,603; 6,193,080; 7,118,078; 7,819,366 and D486,320.

SUMMARY OF EXAMPLE EMBODIMENTS

In one embodiment, a one-piece paint brush holder for removable-insertion use with a container having a bottom surface, an inner side wall and an upper edge is provided. The holder includes a base portion. The holder further includes a post portion having a lower end extending from the base portion, an intermediate portion extending upwardly from the lower end, and an upper end supported above and extending from the intermediate portion. The holder still further includes a generally horizontal support portion extending from the upper end of the post portion and having a distal end. The intermediate portion of the post portion has a hook portion vertically between the base portion and the support portion. The hook portion has a downwardly opening shape to permit the holder to be supported on the upper edge of the container at a position above an inserted position in the container. The base, post, hook and support portions are formed by bending a single rod.

The distal end of the support portion may have an upwardly inclined shape to prevent brush removal from the support portion.

The support portion may extend from the upper end of the post portion to the inner side wall of the container to prevent brush removal from the generally horizontal support portion when the paint brush holder is in the inserted position.

The hook portion and the support portion may contact the inner side wall of the container to prevent brush removal from the generally horizontal support portion when the paint brush holder is in the inserted position.

The intermediate portion may be inclined radially inward from the base portion.

The base portion may be a curved base portion adapted to contact the bottom surface of the container when the paint brush holder is in the inserted position.

In another embodiment, a paint brush holder assembly for removable-insertion use with a container having a bottom surface, an inner side wall and an upper edge is provided. The assembly includes a base having a base attachment portion. The assembly further includes a post having a lower attachment portion at a lower end of the post for attaching the post to the base attachment portion so that an intermediate portion of the post extends upwardly from the lower end and inclined inward from the base. The post has an upper attachment portion at an upper end of the post supported above the intermediate portion. The assembly still further includes at least one generally horizontal support having a support attachment portion for attaching the at least one generally horizontal support to the upper attachment portion so that the at least one generally horizontal support extends from the upper end of the post. Each support has an associated distal end. The assembly further includes at least one hook on the intermediate portion of the post vertically between the base and the support. Each hook has a downwardly opening shape to permit the holder to be supported on the upper edge of the container at a position above an inserted position in the container. Each hook extends in the opposite direction as the inward inclination of the intermediate portion to permit the holder to be raised and supported on the upper edge of the container at a position above the inserted position.

The distal end of each support may have an upwardly inclined shape to prevent brush removal from the support.

The support may extend from the upper end of the post to the inner side wall of the container to prevent brush removal from each generally horizontal support when the paint brush holder is in the inserted position.

The hook and the support may contact the inner side wall of the container to prevent brush removal from each generally horizontal support when the paint brush holder is in the inserted position.

The base and lower attachment portions may form a threaded connection to join the base and post together.

The support and upper attachment portions may form a threaded connection to join the support and post together.

The base and lower attachment portions may form an interference fit connection

The support and upper attachment portions may form an interference fit connection.

The base and lower attachment portions may form a folding locking hinge connection.

The support and upper attachment portions may form a folding locking hinge connection.

The paint brush holder may further include a fastener for joining the base and lower attachment portions together.

The paint brush holder may further include a fastener for joining the support and the upper attachment portions together.

The at least one generally horizontal support may include at least two generally horizontal supports. Each support may extend from the upper end of the post and each support may have the distal end having an upwardly inclined shape.

The at least one hook may include two hooks and each hook may have an inverted J shape to permit the holder to be supported on the upper edge of the container at a position above the inserted position on the container.

The objects, features and advantages of the present invention are readily apparent from the following detailed description of the preferred embodiment when taken in connection with the drawings.

DETAILED DESCRIPTION OF EXAMPLE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
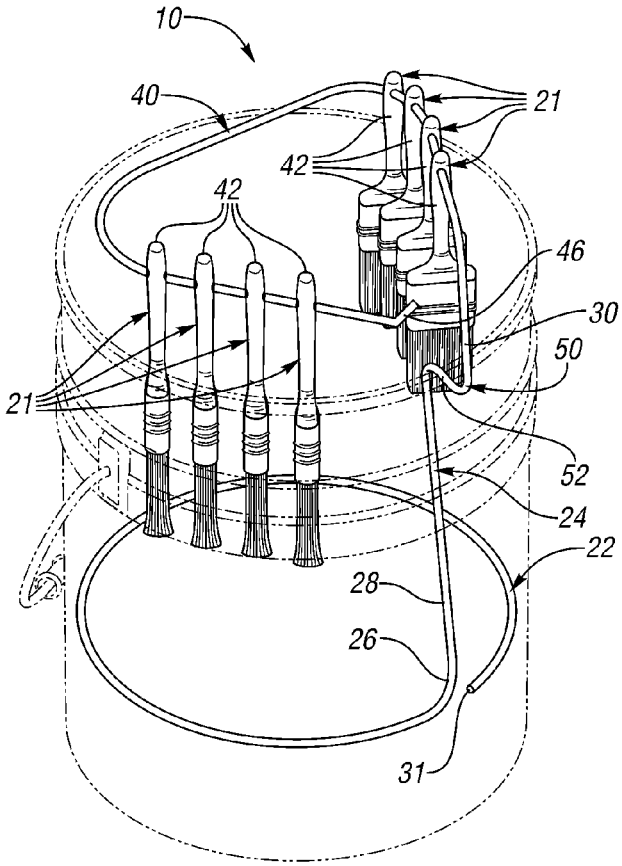
FIG. 1 is a perspective view illustrating a one-piece paint brush holder constructed in accordance with one embodiment of the invention and shown with its base portion in an unbiased position.
Figure 2:
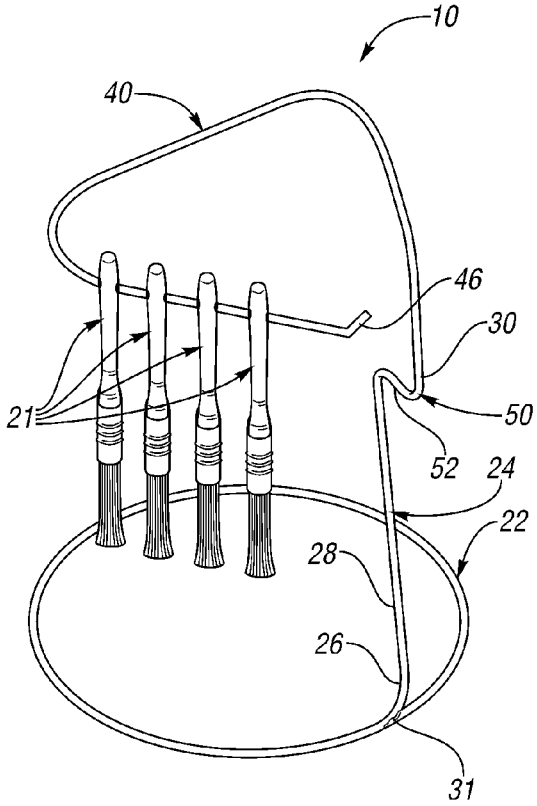
FIG. 2 is a view similar to the view of FIG. 1 with the base portion forming a complete circle.

With reference to FIGS. 1 and 2, a one-piece paint brush holder 10 in accordance with the present invention is adapted for use with a container (not shown, but similar to the container shown in U.S. Pat. No. 7,819,366) that has a bottom surface, an inner side wall and an upper edge. The container may be a bucket, pail or any other suitable container for holding and carrying fluids. For example, the container may be a conventional five-gallon bucket type made from plastic or metal. Furthermore, the container may have a lid. The upper edge of the container receives the lid to keep the holder 10 within the container.

As illustrated in FIGS. 1 and 2, the holder 10 has a base portion 22 and a post portion 24. The post portion 24 has a lower end 26, an intermediate portion 28 and an upper end 30. The lower end 26 is integrally formed with the base portion 22 from a single round rod. The intermediate portion 28 extends upwardly from the lower end 26 of the post portion 24. In addition, the intermediate portion 28 may also incline radially inward from the base portion 22. Furthermore, the upper end 30 is supported above the intermediate portion 28 of the post portion 24.

When the paint brush holder 10 is in an "inserted position," the base portion 22 of the holder 10 contacts the bottom surface of the container. The inner side wall of the container may be tapered radially outward such that the inner side wall near the bottom surface of the container has a smaller diameter than the inner side wall farther upwardly from the bottom surface. The container may hold a fluid, such as solvent or water, such that when the paint brush holder 10 is the "inserted position," the fluid will moisten and clean at least one brush 21 supported on the holder 10.

The base portion 22 may also contact the inner side wall of the container to help support the holder 10 in the "inserted position." When the base portion 22 contacts the inner side wall of the container, a frictional force (not shown) between the base portion 22 and the inner side wall of the container exists. The frictional force between the base portion 22 and the inner side wall helps to prevent the holder 10 from accidentally moving out from the "inserted position" and away from the bottom surface of the container. If the holder 10 moves out from the "inserted position," the brush 21 supported on the holder 10 may be removed from the fluid contained within the container and cause the brush 21 to dry out and/or become damaged. Situations where the holder 10 may accidentally move away from the bottom surface of the container include when the container is transported and when the bottom surface of the container is tilted at an angle relative to a horizontal plane.

The base portion 22 of the paint brush holder 10 may be a curved base portion 22 having a distal end 31 spaced from the lower end 26 of the post 24 (FIG. 1). The curved base portion 22 may be a complete ring base portion 22 wherein the distal end 31 of the base portion 22 is welded to the rest of the base portion 22 at the lower end 26 of the post portion 24 (shown in FIG. 2). The biasing ring-like base portion 22 (shown in FIG. 1) or any other suitably shaped base to vertically support the intermediate portion 28 of the post portion 24 may be provided. When the paint brush holder 10 is in the inserted position, the curved base portion 22 contacts the bottom surface of the container to upwardly support the intermediate portion 28 of the post portion 24.

As illustrated in FIG. 1, the biasing ring-like base portion 22 of the holder 10 may have the distal end 31 separated from the lower end 26 of the post portion 24. When the holder 10 is not in the "inserted position," the distal end 31 may be unbiased and have a larger diameter than the inner side wall near the bottom surface of the container. When the holder 10 is in the "inserted position," the distal end 31 of the biasing ring-like base portion 22 may bend radially inward and bias the ring-like base portion 22 against the inner side wall of the container. When the distal end 31 biases against the inner side wall, additional force is required to remove the holder 10 from the container than if the distal end 31 did not bias against the container. The additional force required to remove the holder 10 helps to prevent the holder 10 from accidentally moving out from the "inserted position."

The base portion 22 of the paint brush holder 10 may be a squared U-shaped base portion (not shown). The squared U-shaped base portion may be formed of round rod. In addition, the squared U-shaped base portion may have two bends on opposing sides of the post portion 24. The squared U-shaped base portion may be used with the container that has a generally rectangular-shaped inner side wall (not shown), but may also be used with the container that has the inner side wall being generally circular.

As shown in FIGS. 1 and 2, the integral paint brush holder 10 has a generally horizontal loop-shaped support portion 40. FIGS. 1 and 2 show the holder 10 as having one horizontal support portion 40, however a holder assembly 110, 110', 210, 310, 310' and 410 of FIGS. 3, 5, 4, 6*a*, 6*b* and 7, respectively, may have two or more horizontal supports 140, 140', 240, 340, 340' and 440, respectively. In general, parts shown in FIGS. 3, 5, 4, 6*a*, 6*b* and 7 which are the same in form or function to the parts or portions of FIGS. 1 and 2 are given the same reference number but have "100," "200," "300" or "400" or a "prime" designation added thereto.

As illustrated in FIGS. 1 and 2, the horizontal support portion 40 is used to hold the brush 21 on the paint brush holder 10. The brush 21 may have a handle portion 42 that includes an opening. The brush 21 may be hung in a generally vertical orientation on the horizontal support portion 40 through the opening in the handle portion 42 of the brush 21.

With continuing reference to FIGS. 1 and 2, the horizontal support portion 40 extends from the upper end 30 of the post portion 24. The horizontal support portion 40 may extend from the upper end 30 to the inner side wall of the container to prevent accidental removal of the at least one brush 21 supported on the horizontal support portion 40 from the horizontal support portion 40 when the holder 10 is in its inserted position.

Again, with continuing reference to FIGS. 1 and 2, the generally horizontal support portion 40 of the paint brush holder 10 has an associated distal end 46. The distal end 46 may have an upwardly inclined shape to help prevent accidental removal of the brush 21 from the support portion 40. The distal end 46 may help prevent accidental removal of the brush 21 both when the holder 10 is in the inserted position and when the holder 10 is positioned on the upper edge of the container. The distal end 46 also prevents the at least one brush 21 from sliding past the distal end 46 of the generally horizontal support portion 40 and contacting the inner side wall of the container. Contact between the brush 21 and the inner side wall of the container can damage the bristles of the brush 21.

As shown in FIGS. 3 through 7, two horizontal supports 140, 140', 240, 340, 340' and 440 for each holder assembly 110, 110', 210, 310, 310' and 410, respectively, are shown, wherein each horizontal support may be at an angle less than ninety degrees from an adjacent horizontal support to provide sufficient spacing between the brush 21 (not shown) hung from the horizontal support and the inner side wall of the container.

Referring again to FIGS. 1 and 2, the paint brush holder 10 has a hook portion 50. The hook portion 50 is on the intermediate portion 28 of the post portion 24 vertically between the base portion 22 and the generally horizontal support portion 40. The hook portion 50 has a downwardly opening shape. The downwardly opening shape may include a downwardly J-shaped opening 52. The J-shaped opening 52 provides spacing between the intermediate portion 28 of the post portion 24 and the inner side wall of the container to facilitate removal of the hook portion 50 from the upper edge of the container.

The holder 10 may be partially removed from the container and positioned on the upper edge of the container using the hook portion 50. The downwardly opening shape of the hook portion 50 receives the upper edge of the container when the holder 10 is positioned on the upper edge of the container. When the holder 10 is supported on the upper edge of the container, the holder 10 is at a position above the inserted position to allow drying of the brush 21 as well as removal of the brush 21 from the holder 10.

The hook portion 50 may extend in the opposite direction as the radial inward inclination of the post portion 24. The hook portion 50 extending in the opposite direction as the inclination of the post portion 24 permits proper positioning of the horizontal support portion 40 relative to the container when the holder 10 is supported on the upper edge of the container. Proper positioning of the horizontal support portion 40 helps to prevent contact between the brush 21 and the inner side wall of the container, which could damage to the bristles of the brush 21.

The hook portion 50 may contact the inner side wall of the container to provide a radially inward-directed force (not shown) to prevent the distal end 46 of the horizontal support portion 40 from disengaging the inner side wall of the container. If the distal end 46 of the horizontal support portion 40 disengages the inner side wall of the container, then the brush 21 may be accidentally removed from the horizontal support portion 40 when the holder 10 is in the inserted position. Furthermore, if the distal end 46 of the horizontal support portion 40 disengages the inner side wall of the container, then the paint brush holder 10 may accidentally move out from the inserted position and rattle within the container. Rattling of the holder 10 within the container can cause stress and damage to the holder 10 as well as damage to the bristles of the brush 21 if the bristles of the brush 21 contact the inner side wall of the container.

The hook portion 50 as well as the base portion 22, the post portion 24 and the support portion 40 may be formed by bending a single round rod. Round rod may be made of metal such as aluminum, stainless steel and various rust-resistant metal alloys.

Figure 3:
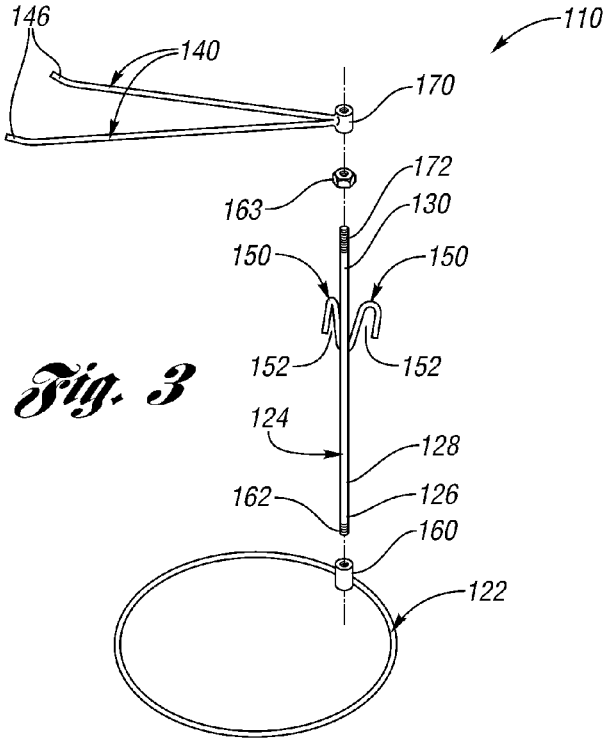
FIG. 3 is an exploded perspective view illustrating a multi-piece paint brush holder to be assembled from a kit of parts in accordance with another embodiment of the invention.

Referring again to FIGS. 3 through 7, bases 122, 122', 222, 322 and 422 for the assemblies 110, 110', 210, 310 and 410, respectively, preferably include a base attachment portion 160, 160', 260, 360 and 460, respectively. Referring specifically to FIGS. 3 and 5, the base attachment portions 160 and 160' are preferably internally threaded to form a threaded connection with externally threaded lower attachment portions 162 and 162', respectively, formed at the lower ends of posts 124 and 124', respectively, to join the posts 124, 124' to their respective bases 122, 122'.

Figure 4:
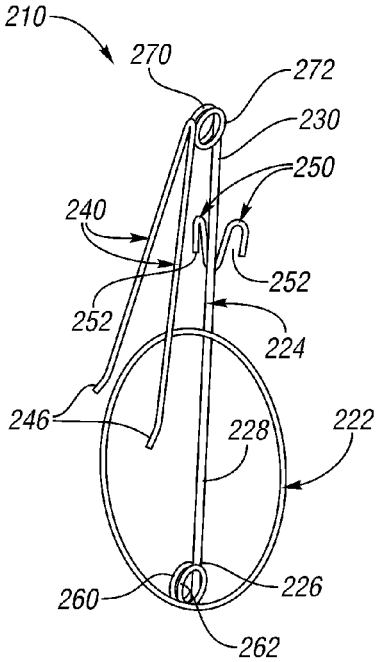
FIG. 4 is a perspective view of a paint brush holder with a base, a post and pair of horizontal supports folded for packaging purposes.
Figure 5:
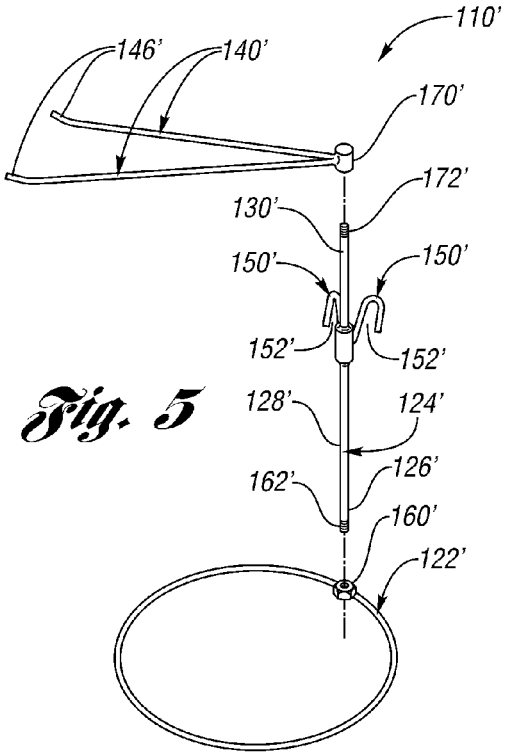
FIG. 5 is a view similar to the view of FIG. 3 but without the lock nut of FIG. 3 and a different base attachment portion.

Referring specifically to FIG. 4, the base attachment portion 260 of the base 222 forms a lower folding locking hinge connection with a lower attachment portion 262 formed at the lower end of the post 224. Such a folding locking hinge connection is well known in the art of hinges (i.e. such as with pocket knives, tables with foldable legs, etc.).

Figure 6A:
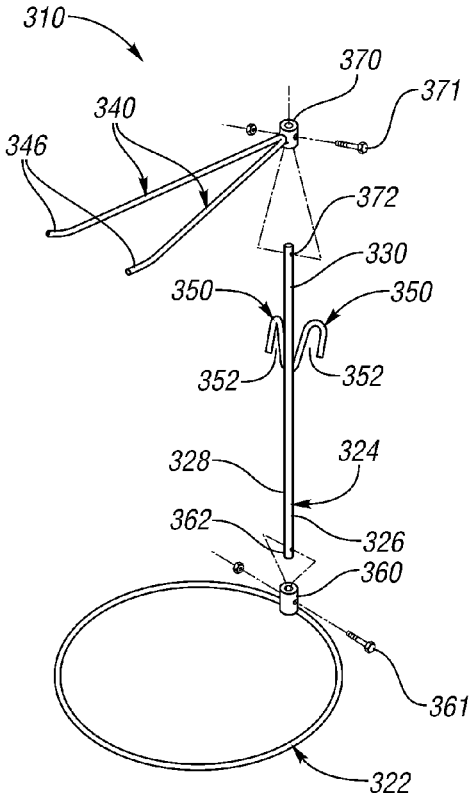
FIG. 6*a* is an exploded perspective view illustrating a multi-piece paint brush holder with fasteners to be assembled from a kit of parts in accordance with still another embodiment of the invention.

Referring specifically to FIG. 6*a*, an apertured base attachment portion 360 of the base 322 together with a fastener preferably in the form of either a cotter pin (not shown) or a nut and a bolt 361 form a connection with an apertured lower attachment portion 362 formed at the lower end of the post 324 to join the post 324 to the base 322.

Figure 7:
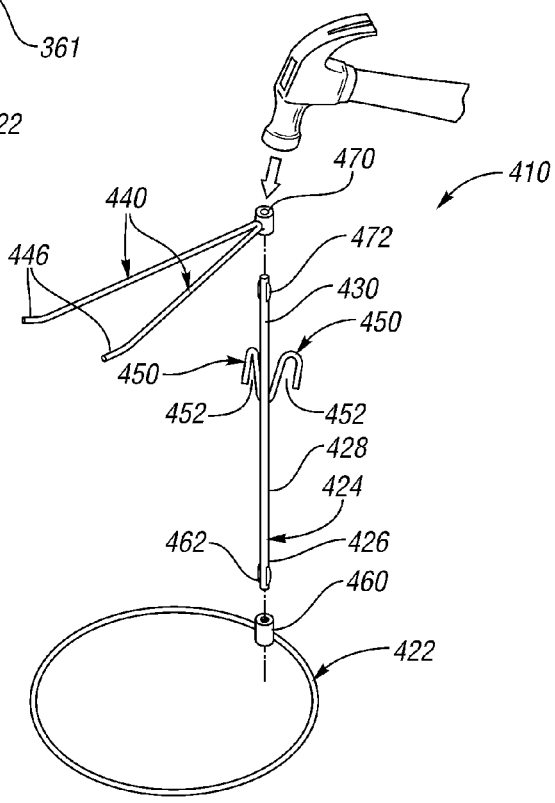
FIG. 7 is an exploded perspective view illustrating a multi-piece paint brush holder to be assembled (here with a hammer) from a kit of parts in accordance with yet another embodiment of the invention.

Referring specifically to FIG. 7, the hollow base attachment portion 460 of the base 422 forms an interference fit connection with "pinched" lower attachment portion 462 formed at the lower end of the post 424 to join the post 424 to the base 322 by forcing the portion 462 into the portion 466 such as by pounding with a hammer.

Referring again to FIGS. 3 through 7, all of the supports 140, 140', 240, 340, 340' and 440 preferably include a support attachment portion 170, 170', 270, 370, 370' and 470, respectively. Referring specifically to FIGS. 3 and 5, the support attachment portions 170 and 170' are preferably internally threaded to form a threaded connection with externally threaded upper attachment portions 172 and 172', respectively, formed at upper ends of the posts 124 and 124', respectively, to join the posts 124, 124' to their respective supports 140, 140'. The holder 110 of FIG. 3 includes a lock nut 163 to lock the support 140 along the post 124.

Referring specifically to FIG. 4, the support attachment portion 270 of the support 240 forms an upper folding locking hinge connection with upper attachment portion 272 formed at the upper end of the post 224. The upper folding locking hinge connection is the same or similar to the previously described lower folding locking hinge connection.

Figure 6B:
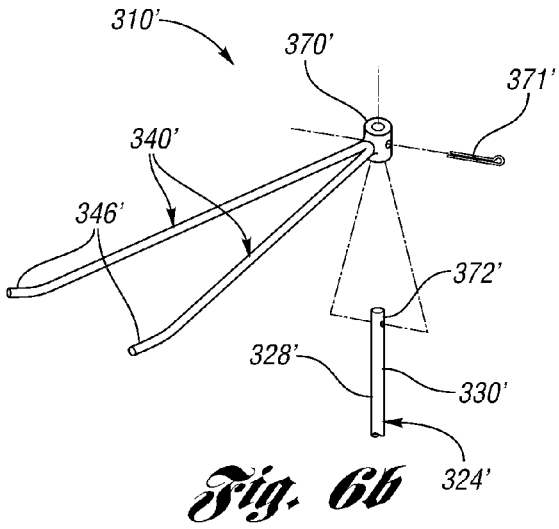
FIG. 6*b* is an enlarged exploded perspective view, partially broken away, showing the upper part of the paint brush holder of FIG. 6*a* but using a cotter pin instead of a nut and a bolt.

Referring specifically to FIGS. 6*a* and 6*b*, an apertured support attachment portion 370 of the support 340 together with a fastener preferably in the form of either a cotter pin 371' (FIG. 6*b*) or a nut and a bolt 371 (FIG. 6*a*) form a connection with an apertured upper attachment portion 372 formed at the upper end of the posts 324 to join the posts 324, 324' to their respective supports 340, 340'.

Referring specifically to FIG. 7, the hollow support attachment portion 470 forms an interference fit connection with a "pinched" upper attachment portion 472 formed at the upper end of the post 424 to join the post 424 to the support 440 by forcing the portion 472 into the portion 470 such as by pounding with a hammer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A one-piece paint brush holder for removable-insertion use with a container having a bottom surface, an inner side wall and an upper edge, the holder comprising:

a base portion;

a post portion having a lower end extending from the base portion, an intermediate portion extending upwardly from the lower end, and an upper end supported above and extending from the intermediate portion; and a generally horizontal support portion extending from the upper end of the post portion and having a distal end extending from the support portion;

wherein the intermediate portion of the post portion has a hook portion vertically between the base portion and the support portion, and having a downwardly opening shape to permit the holder to be supported on the upper edge of the container at a position above an inserted position in the container, and wherein the base, post, hook and support portions are integrally formed by bending a single rod without the need for joining or fastening the portions together.

2. The paint brush holder of claim 1, wherein the distal end of the support portion has an upwardly inclined shape to prevent brush removal from the support portion.

3. The paint brush holder of claim 1, wherein the support portion extends from the upper end of the post portion to the inner side wall of the container when the holder is supported on the upper edge of the container to prevent brush removal from the generally horizontal support portion when the paint brush holder is in the inserted position.

4. The paint brush holder of claim 1, wherein the hook portion and the support portion contact the inner side wall of the container when the holder is supported on the upper edge of the container to prevent brush removal from the generally horizontal support portion when the paint brush holder is in the inserted position.

5. The paint brush holder of claim 1, wherein the intermediate portion is inclined radially inward from the base portion.

6. The paint brush holder of claim 1, wherein the base portion is a curved base portion adapted to contact the bottom surface of the container when the paint brush holder is in the inserted position.

7. The paint brush holder of claim 1, wherein the support portion is loop-shaped and ends at the distal end to enable paint brushes to be hung in a loop about the loop-shaped support portion.

* * * * *